US005397404A

United States Patent [19]

Hansen et al.

[11] Patent Number: 5,397,404

[45] Date of Patent: Mar. 14, 1995

[54] HEAT TREATMENT TO REDUCE EMBRITTLEMENT OF TITANIUM ALLOYS

[75] Inventors: James O. Hansen, Hobe Sound; David Novotnak, Jupiter, both of Fla.

[73] Assignee: United Technologies Corporation, Hartford, Conn.

[21] Appl. No.: 996,211

[22] Filed: Dec. 23, 1992

[51] Int. Cl.[6] ..... C22C 14/00

[52] U.S. Cl. ..... 148/669; 148/421; 148/670

[58] Field of Search ..... 148/669, 670, 421

[56] References Cited

U.S. PATENT DOCUMENTS

| | | | |
|---|---|---|---|
| 3,147,115 | 9/1964 | Vordahl | 148/671 |
| 4,098,623 | 7/1978 | Ibaraki et al. | 148/669 |
| 4,422,887 | 12/1983 | Neal et al. | 148/133 |
| 4,799,975 | 1/1989 | Ouchi et al. | 148/671 |
| 5,032,189 | 7/1991 | Eylon et al. | 148/11.5 |
| 5,171,375 | 12/1992 | Wakabayashi et al. | 148/671 |
| 5,176,762 | 1/1993 | Berczik | 148/407 |

OTHER PUBLICATION

Froesetal. Jour. Metals, Jul. 1985, po 28–37.

*Primary Examiner*—Upendra Roy

[57] ABSTRACT

A non-burning Ti-V-Cr alloy which is heat treated to decrease its susceptibility to embrittlement in gas turbine engine compressor applications. The invention heat treat cycle consists of an isothermal holding period below the alpha solvus temperature, a slow ramp down to a lower temperature, a second holding period at a lower temperature, a third ramp down to an even lower temperature, and a final holding period at the third temperature. Other suitable heat treat cycles within the concept of the invention include a single holding period below the alpha solvus temperature double holding periods below the alpha solvus temperature with a ramp from a higher to a lower temperature and a continuous ramp below the alpha solvus temperature with no holding period.

5 Claims, 3 Drawing Sheets

HEAT TREATMENT TO REDUCE EMBRITTLEMENT OF TITANIUM ALLOYS

The Government has rights in this invention, pursuant to Contract No. F33657-83-C-0092 awarded by the Department of the Air Force.

TECHNICAL FIELD

The present invention relates to the heat treatment of titanium alloys, and more specifically to a heat treatment of non-burning Ti-V-Cr alloys which permits an increase in the operating temperature without embrittlement of the alloy.

BACKGROUND ART

Pure titanium exists in the alpha crystalline form at room temperature, but transforms to the beta crystalline form at 1621° F. (883° C.). Various alloying elements increase the stability of the beta phase at lower temperatures. Certain known titanium alloys contain sufficient amounts of the beta phase stabilizers that they are largely beta phase under most temperature conditions and are referred to as beta titanium alloys. The subject of these prior "beta" titanium alloys is discussed in "The Beta Titanium Alloys," by F. H. Froes et al., *Journal of Metals,* 1985, pp. 28,37.

Titanium alloys possess an ideal combination of strength and low density for many aerospace applications, including gas turbine engines, and particularly gas turbine engine compressor blades, vanes and related hardware. However, titanium is a highly reactive metal and can undergo sustained combustion under conditions encountered in gas turbine engine compressors. In such compressors, ambient air is compressed at temperatures on the order of 850° F. (454° C.) to pressures which may be on the order of 400 psi. The air can flow at 450 feet per second as it passes through the compressor. Under these conditions common commercial titanium alloys will burn uncontrollably if ignited. Ignition can occur by friction arising from the ingestion of foreign objects or as a result of mechanical failures which cause contact between moving blades and stationary objects, at least one of which is made of titanium alloy, with friction between two titanium components being particularly troublesome. Such combustion is a great concern to gas turbine engine designers who have gone to great lengths to guard against rubbing between titanium components.

A class of true beta titanium alloys based on compositions of titanium-vanadium-chromium which occur in the titanium-vanadium-chromium phase diagram bounded by the points Ti-22V-36Cr, Ti-40V13Cr and Ti-22V-13Cr (all percentages herein being weight percent unless otherwise noted) has been shown to possess a high degree of resistance to burning (referred to hereinafter as non-burning) under the operating conditions in a gas turbine engine. These alloys also exhibit creep strengths which are greater than those exhibited by the strongest commercial alloys (i.e., Ti-6-2-4-2) at elevated temperatures. A variety of quaternary (and higher) alloying elements may be added to the basic composition to modify the alloy properties.

A particular titanium base alloy, having a nominal composition of 35% V, 15% Cr, balance Ti, has been historically used for gas turbine applications in the fully solutioned (all beta) condition. When operating above 850° F. (454° C.) for extended periods of time, alpha phase precipitates as an essentially continuous film in the grain boundaries and embrittles the alloy, thus shortening its useful lifetime.

What is needed is a non-burning titanium alloy which can operate for extended periods of time at elevated temperatures without becoming embrittled.

What is further needed is a method of heat treating a non-burning titanium alloy so as to render it resistant to the embrittling effects of long term exposure at elevated temperatures.

DISCLOSURE OF INVENTION

The non-embrittling material of the present invention comprises a non-burning titanium-vanadium-chromium alloy with a composition defined by the region designated in FIG. 1 whereby the alloy is heat treated to render it resistant to precipitation of detrimental particles under normal gas turbine engine operating conditions.

The process of the present invention comprises an initial step of heating the material above the alpha solvus temperature for a time sufficient to produce an all beta structure, followed by heat treating below the alpha solvus temperature to produce a precipitate consisting of coarse, stable alpha phase particles generally situated in the grain boundaries.

The initial heat treat step consists of holding the material at about 50° F. (28° C.) above the alpha solvus temperature for from about one to about ten hours, with about one hour generally preferred.

The sub-alpha solvus temperature heat treatment may be either isothermal or ramped. The isothermal heat treatment is conducted at a temperature about 150° F. below the solvus temperature for about two hours, and produces a coarse, stable precipitate of alpha phase, which is a form of $TiO_2$.

The most preferred ramp heat treatment generally consists of holding at a first temperature below the alpha solvus for a period of time, cooling at a fairly slow rate to a second, lower temperature, holding for a period of time at the second temperature, cooling to a still lower third temperature, holding for a period of time at the third temperature, and cooling to room temperature. The ramp heat treatment initially produces a coarse precipitate of alpha phase, which is further coarsened during the ramp and hold portions of the cycle.

While the preferred ramp heat treatment uses three successively lower sub-solvus holding temperatures, the invention process can also be carried out effectively with more or fewer holding periods, or with a ramp from a first sub-solvus temperature down to a second lower temperature without any intermediate holding periods. While longer total exposure times in the 1000°–1300° F. (538°–704° C.) temperature range would tend to improve the properties of the material, an optimum cycle must also consider the overall cost of the operation.

These, and other features and advantages of the invention, will be apparent from the description of the Best Mode, read in conjunction with the drawings.

BEST MODE FOR CARRYING OUT THE INVENTION

Figure 1:
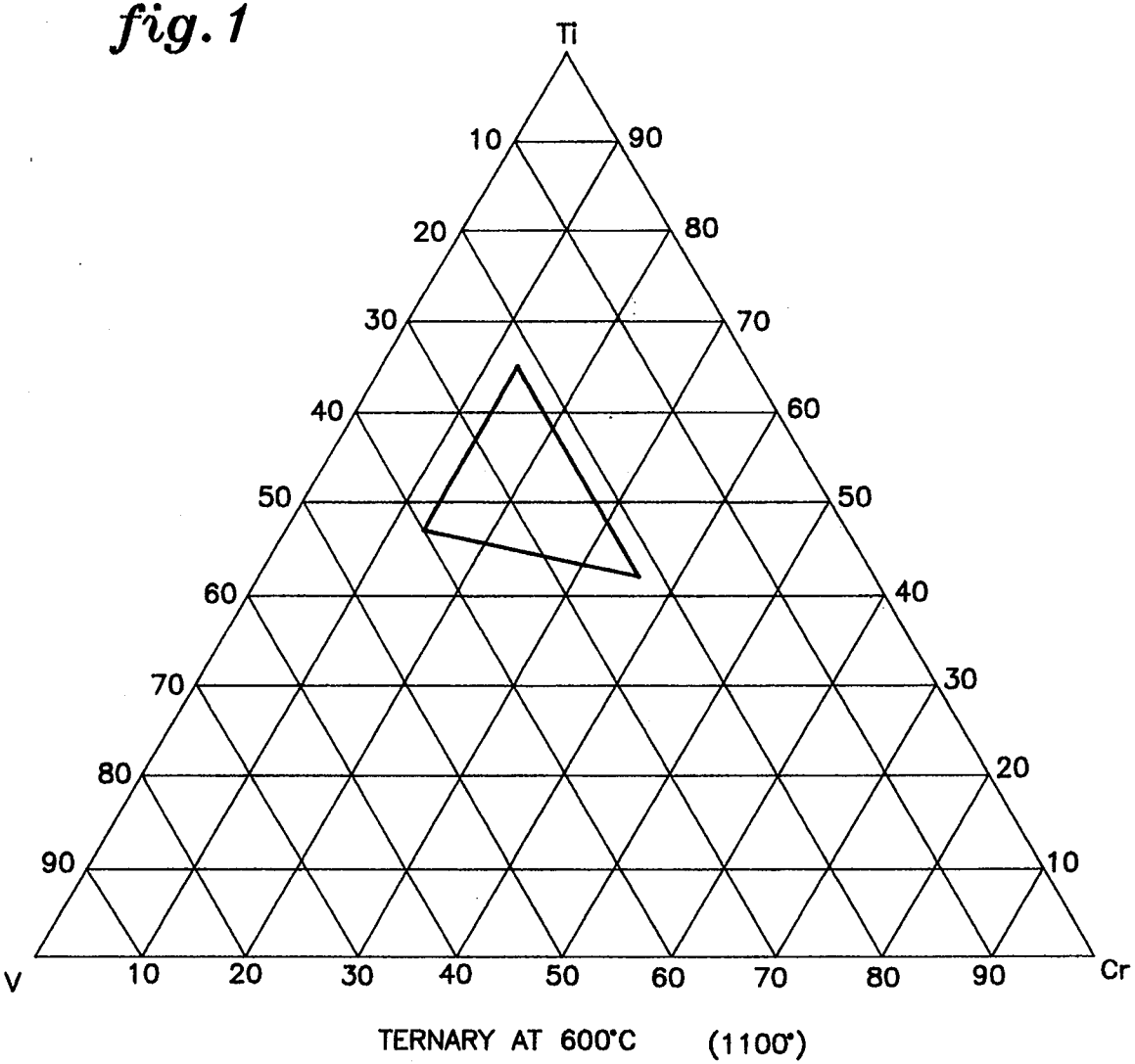
FIG. 1 is an isothermal section of the Ti-V-Cr phase diagram showing the general composition region of the non-burning alloys of this invention.
Figure 2:
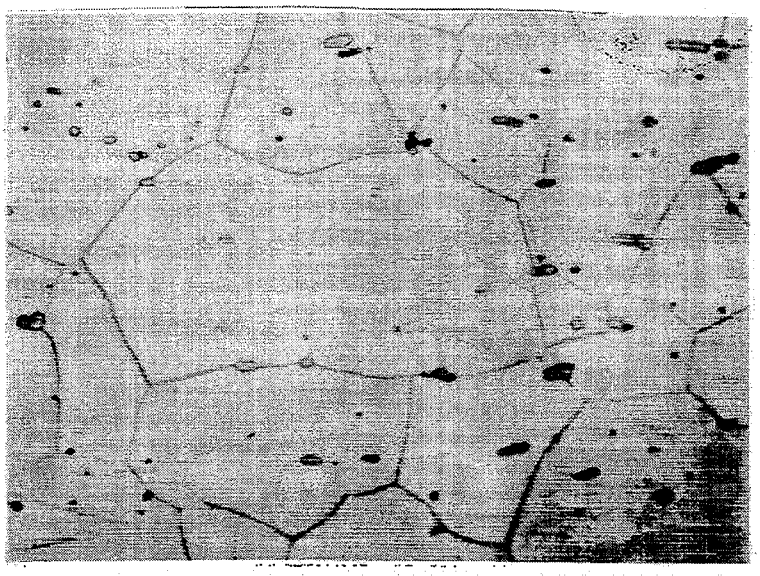
FIG. 2 is a photomicrograph showing the microstructure of PWA 1274 in the as-solutioned condition.

A titanium base alloy containing 35% V, 15% Cr, which lies within the composition ranges of a non-burning alloy as illustrated in FIG. 1, and which is hereinafter referred to as PWA 1274, has been shown to be highly burn-resistant in gas turbine engine compressor applications. It is commonly used in the solutioned condition, and has a microstructure as shown in FIG. 2. The solutioning process is performed at about 1500° F. (816° C.), approximately 50° F. (28° C.) above the alpha solvus temperature of 1450° F. (788° C.), for about one hour.

Figure 3:
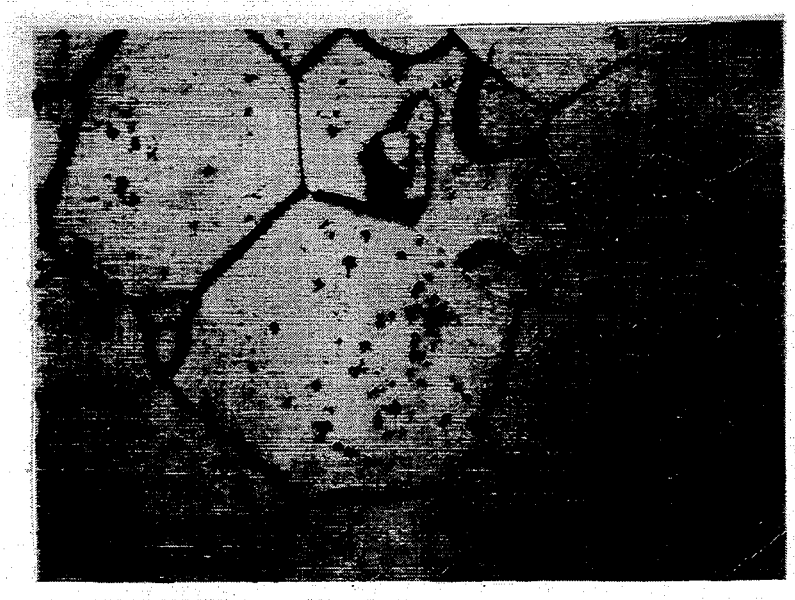
FIG. 3 is a photomicrograph showing the as solutioned PWA 1274 material after 500 hours at 1000° F. in air.

While operating above 850° F. (454° C.) for extended periods of time, the precipitation of alpha phase as a film in the grain boundaries decreases the ductility of the alloy drastically. As measured at room temperature, the elongation of fully solutioned material decreases from an initial value of about 20% to about 2% after exposure in air at 1000° F. (538° C.) for 500 hours. The effect of this extended exposure on the microstructure of the alloy is shown in FIG. 3.

Figure 4:
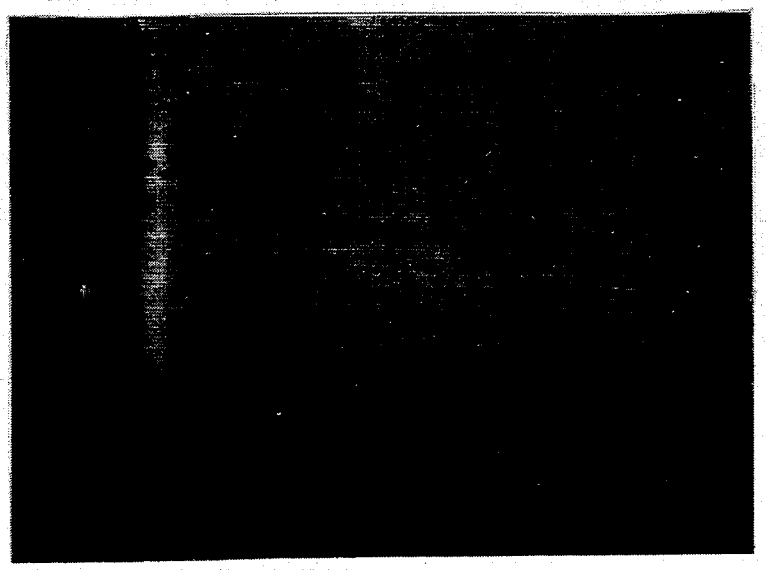
FIG. 4 is a photomicrograph of PWA 1274 processed according to the invention.

By heat treating the solutioned, essentially all beta phase, material below the alpha solvus temperature, but at a temperature higher than the normal use temperature, the alpha phase, which is a form of $TiO_2$, is caused to precipitate in the grain boundaries as coarse, stable particles. These alpha particles are much less harmful to the material than the grain boundary films discussed above. FIG. 4 shows a typical microstructure of this heat treated material.

The heat treat cycle of the invention requires that the material be in the fully solutioned condition. The isothermal sub-solvus treatment involves heating the material at a temperature about 150° F. (83° C.) below the alpha solvus temperature. The solvus temperature is strongly dependent on the oxygen content of the material, so the solvus temperature must generally be determined in order to establish the heat treat temperature for the sub-solvus step. The time required is between about one-half and about ten hours, with about two hours being generally preferred. The cooling rate from the sub-solvus treatment temperature to room temperature should be at least 100° F. (56° C.) per hour to avoid grain boundary precipitation.

The most preferred embodiment of the ramp heat treatment process includes heating isothermally at a temperature about 150° F. (83° C.) below the solvus temperature for a period of about one to ten hours, with the preferred time being about two hours, cooling at a rate of about 25°–100° F. (14°–56° C.) per hour, with a preferred rate of about 75° F. (42° C.) per hour, to a temperature about 100° F. (55° C.) below the first temperature, holding at the second temperature for a period of about one to about ten hours, preferably about six hours, cooling to a third temperature about 200° F. (111° C.) below the second temperature and holding for a period of about one to about ten hours, preferably about six hours, and cooling to room temperature.

Figure 5:
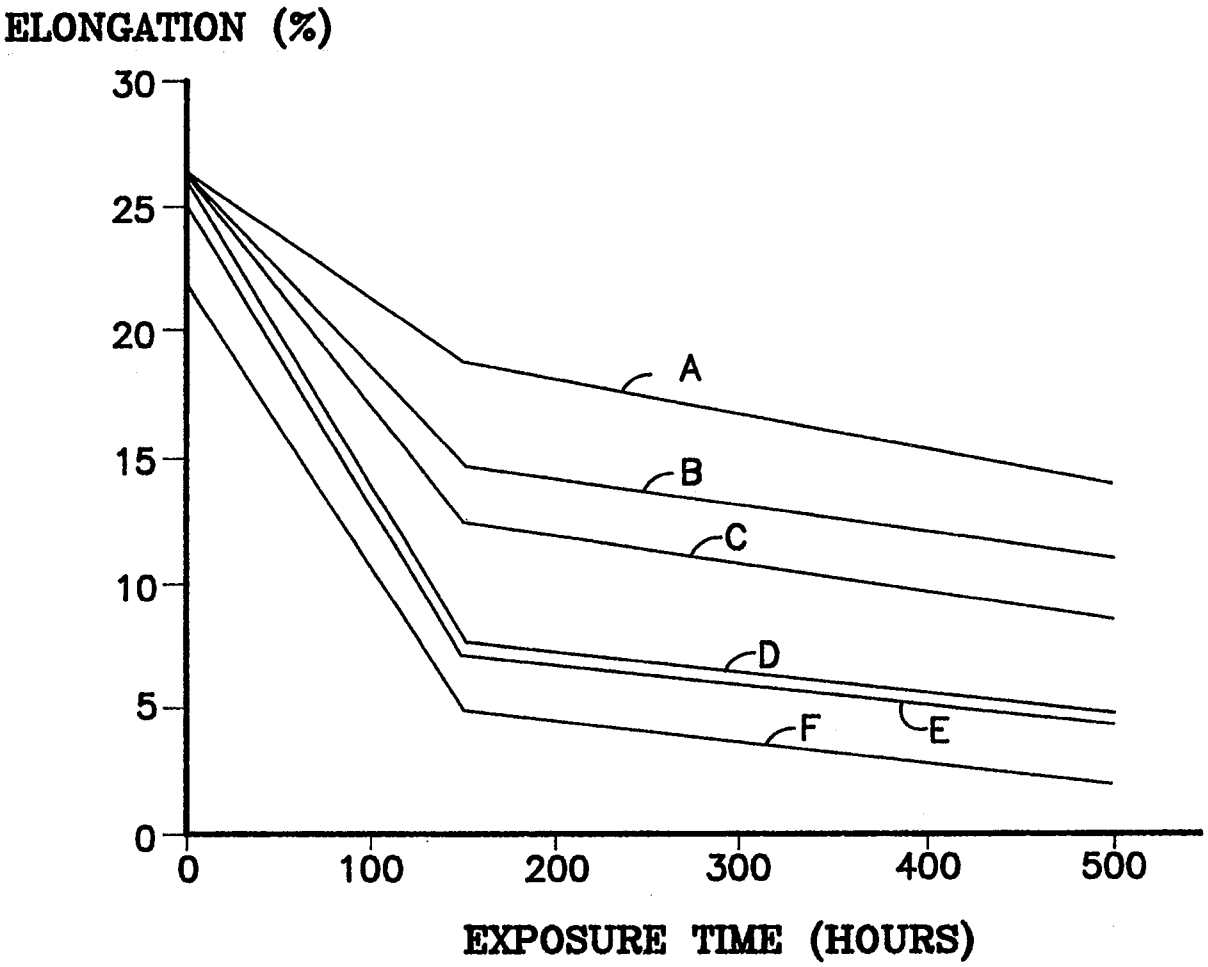
FIG. 5 is a graph showing the results of room temperature elongation testing of PWA 1274 after various heat treat cycles according to the invention process followed by exposure at 1000° F. (538° C.) for 0–500 hours.

FIG. 5 is a graph showing the results of ductility testing of PWA 1274 which has been sub-solvus heat treated using various heat treat cycles according to the present invention. The sub-solvus heat treat cycles applied to the solutioned material are indicated in Table I.

TABLE I

| | |
|---|---|
| A | 1300° F. (704° C,)/2 hr, cool at 75° F. (42° C.)/hr to 1200 F. (649° C.)/6 hr, cool at 75F (42)/hr to 1000 F./6 hr, cool at > 100 F./hr to room temperature. |
| B | 1300 F. (704° C.)/2 hr, cool at 25 F. (14° C.)/hr to 1050 F. (566° C.)/1 hr, cool at > 100 F. (56° C.)/hr to room temp. |
| C | 1300 F. (704° C.)/2 hr, cool at 25 F. (14° C.)/hr to 1150 F. (621° C.)/1 hr, cool at > 100 F. (56° C.)/hr to room temp. |
| D | 1300 F. (704° C.)/hr, cool at > 100 F. (56° C.)/hr to room temperature. |
| E | 1200 F. (649° C.)/2 hr, cool at > 100 F. (56° C.)/hr to room temperature. |
| F | As solutioned (1500° F. or 816° C. for one hour). |

In all cases the heat treated material showed improved ductility compared to the solutioned material. Even with no exposure time at 1000° F. (538° C.), the heat treated samples had better ductility than the solutioned material. This is attributed to the fact that oxygen dissolved in the beta phase is caused to migrate to the grain boundaries during the heat treat cycle, where it precipitates as alpha phase, or $TiO_2$, particles. The decrease in dissolved oxygen content in the beta phase increases the ductility of the alloy.

While the measured ductility of the solution heat treated material decreased to about 2% after 500 hours at 1000° F. (538° C.), the ductility for the sub-solvus isothermally heat treated materials decreased to about 5% after the same exposure. This indicates that the benefits attributed to controlled removal of dissolved oxygen from the beta phase are significant.

The application of a ramp heat treat cycle to solution heat treated material prior to exposure to elevated temperatures improved the ductility to an even greater extent. The additional time attributed to the ramp cycle and the second holding period apparently allowed a greater portion of the dissolved oxygen to migrate to the grain boundaries.

The ramp treatment to 1150° F. (621° C.) results in an elongation of about 8.5% after 500 hours at 1000° F. (538° C.), which is a significant improvement over the elongation after exposure of the isothermally heat treated material to the same conditions. The ramp treatment to 1050° F. (566° C.) results in an elongation of about 11.5% after the same elevated temperature exposure, which is an improvement of about 30% over the elongation of the 1150° F. (621° C.) ramp heat treated material. This improvement is attributed to the additional time at the heat treat temperatures, since four more hours were required in the ramp portion of the cycle to cool down to 1050° F. (566° C.) (at 25° F., or 14° C., per hour) than were required to cool to 1150° F. (621° C.).

The three-step ramp heat treatment involved holding at 1300° F. (704° C.) for two hours, cooling at 75° F. (42° C.) to 1200° F. (649° C.), holding for six hours, cooling at 75° F. (42° C.) to 1000° F. (538° C.), holding for six hours and cooling to room temperature. As shown in FIG. 5, the elongation of this material was about 15% after 500 hours at 1000° F. (538° C.), which is an improvement over the two-step process. The greater exposure of the material to the elevated temperatures of the heat treat cycles during the three-step process seems to account for the increase in measured ductility.

Although this invention has been shown and described with respect to detailed embodiments thereof, it will be understood by those skilled in the art that various changes, omissions and additions in form and detail thereof may be made without departing from the spirit and scope of the claimed invention.

We claim:

1. A method to improve the high temperature stability and embrittlement resistance of a true beta titanium alloy based on titanium and containing a nominal composition of 35% vanadium and about 15% chromium and having an alpha solvus temperature, the improvement comprising a. heating the alloy above the alpha solvus temperature for a period of time sufficient to solutionize any alpha phase present, to produce a fully beta phase microstructure;

b. heating the alloy at a temperature about 150° C. below the alpha solvus temperature and holding for a period of time;

c. cooling at a controlled rate, whereby a small quantity of the alpha phase is caused to precipitate and large precipitates rather than a continuous grain boundary film.

2. A method as in claim 1 wherein the alpha solvus temperature is about 788° C.

3. A method as in claim 1 wherein the alloy is held at a temperature about 150° C. below the alpha solvus for a period of time between about 0.5 hours and 10 hours.

4. A method as in claim 1 wherein the alloy is cooled from the sub-solvus heat treatment temperature of about 150° C. below the alpha solvus temperature, at a slow rate to at least one lower temperature and held at this at least one lower temperature for a period of at least one hour.

5. A method as in claim 1 wherein, after subsequent exposure at a temperature of about 538° C. for about 500 hours the heat treated alloy exhibits a tensile ductility of at least about 5% when measured at room temperature.

* * * * *